US007905039B2

(12) United States Patent
Karovic

(10) Patent No.: US 7,905,039 B2
(45) Date of Patent: Mar. 15, 2011

(54) TOWEL SECURING APPARATUS

(76) Inventor: Frank E. Karovic, Galloway, NJ (US)

( * ) Notice: Subject to any disclaimer, the term of this patent is extended or adjusted under 35 U.S.C. 154(b) by 0 days.

(21) Appl. No.: 12/284,176

(22) Filed: Sep. 19, 2008

(65) Prior Publication Data

US 2010/0072794 A1 Mar. 25, 2010

(51) Int. Cl.
*G09F 3/00* (2006.01)
*G09F 3/14* (2006.01)

(52) U.S. Cl. ..... 40/320; 40/665

(58) Field of Classification Search ..... 40/320, 40/665; D2/625; 297/188.01, 188.2
See application file for complete search history.

(56) References Cited

U.S. PATENT DOCUMENTS 1,397,079 A * 11/1921 Cohen ..... 40/665
2,160,368 A * 5/1939 Monesson ..... 2/321
4,797,793 A * 1/1989 Fields ..... 362/105
5,034,862 A * 7/1991 Liston ..... 362/105
5,117,510 A * 6/1992 Broussard et al. ..... 2/209.3
D344,624 S * 3/1994 Schnel et al. ..... D2/629
5,915,532 A * 6/1999 Williams ..... 2/171
6,189,968 B1 * 2/2001 Emanuel et al. ..... 297/188.01
7,096,544 B2 * 8/2006 Lusardi ..... 24/306
2002/0139823 A1 * 10/2002 Johnson ..... 224/250
2005/0166439 A1 * 8/2005 Ludlow et al. ..... 40/665
2005/0173073 A1 * 8/2005 Chernoff ..... 156/556
2006/0253957 A1 * 11/2006 Orozco ..... 2/171

* cited by examiner

*Primary Examiner* — Cassandra Davis
(74) *Attorney, Agent, or Firm* — Eugene E. Renz, Jr.

(57) ABSTRACT

A towel securing apparatus is disclosed. The towel securing apparatus comprises a strip of material that is formed into a loop, and has a label attached to the loop. It is contemplated that the label may be used for advertising and various other types of promotional purposes (e.g. sports teams, etc. . . . ). It is also contemplated that the apparatus may be installed on a chair such that the label is oriented on the back side of the chair. Additional embodiments provide for various ways to attach an item to the apparatus. This serves to keep common items handy (e.g. sunglasses, camera, etc. . . . ) while at an outdoor venue, such as the beach, pool, on a boat, or at a concert, for example.

9 Claims, 8 Drawing Sheets

TOWEL SECURING APPARATUS

FIELD OF THE INVENTION

The present invention relates to chairs and chaises and more particularly to an apparatus for securing a towel to a chair.

BACKGROUND

Beach and pool lounge chairs and chaises (hereinafter generally referred to as "chairs") used on beaches, boat decks, near swimming pools, and on lawns are often covered by beach towels to provide a more comfortable environment in which to relax, avoid the tacky feeling of plastic and the more harsh feeling of wood, and to absorb any perspiration or dripping water. Furthermore, for sanitary reasons, it may be desirable to place a towel over a chair used in public, such as at a sports stadium. When an outdoor chair is not occupied, there is the chance that a gust of wind may blow the towel from the chair. Furthermore, just the act of getting out of the chair, or moving around in the chair, can cause the towel to shift or fall from the chair. Therefore, it is desirable to provide a simple, economical, and practical apparatus to address this situation.

SUMMARY OF THE INVENTION

Embodiments of the present invention provide a towel securing apparatus. The towel securing apparatus comprises a strip of material that is formed into a loop, and has a label attached thereto. It is contemplated that the label, and/or material itself, may be used for advertising and various other types of promotional purposes. Examples of such promotions include, but are not limited to, sports teams, hotel names, cruise line names, suntan lotion company, beverage company, and clothing company. It is also contemplated that the apparatus may be installed on a chair such that the label is oriented on the back side of the chair. Additional embodiments provide for various ways to attach an item to the apparatus. This serves to keep common items handy (e.g. sunglasses, camera, beverages, books, suntan lotion, phones, and PDAs, etc.) while at an outdoor venue, such as the beach, pool, on a boat, or at a concert, for example. Embodiments of the present invention may also be used to secure a towel to an automobile seat, and may be particularly handy for use in a convertible, jeep, or other SUV type of vehicle.

Embodiments of the present invention provide an apparatus for securing a towel to a chair, comprising:

a loop of elastic material; and a label disposed on the loop, the label comprising an upper portion and a lower portion.

Additional embodiments of the present invention further provide two end loops disposed at opposite ends of the loop of elastic material.

Additional embodiments of the present invention further provide a plurality of holes formed within the loop of elastic material.

Additional embodiments of the present invention provide an apparatus wherein the label is attached to the loop of elastic material on the upper portion of the label, and wherein the label is configured to hang from the upper portion, whereby the label is oriented in a substantially vertical position.

Additional embodiments of the present invention provide an apparatus wherein the lower portion of the label has a weight affixed thereto.

Additional embodiments of the present invention provide an apparatus wherein the weight is comprised of bean bag fill material.

Additional embodiments of the present invention provide an apparatus wherein the weight is comprised of metal.

Additional embodiments of the present invention further provide a pouch, said pouch configured and disposed to hang from one of the two end loops.

Additional embodiments of the present invention further provide a pouch, the pouch configured and disposed to hang from one of the plurality of holes formed within the loop of elastic material.

Additional embodiments of the present invention further provide an apparatus for securing a towel to a chair that comprises a piece of elastic material, the piece of elastic material having a first end and a second end;

a first fastener attached to the first end of the piece of elastic material; and a second fastener attached to the second end of the piece of elastic material.

Additional embodiments of the present invention further provide an apparatus in which the first fastener and second fastener are hook-and-loop fasteners.

Additional embodiments of the present invention further provide an apparatus in which the first fastener and second fastener are magnetic fasteners.

Additional embodiments of the present invention further provide an apparatus in which the first fastener and second fastener are mated clips.

Additional configuration details are described in the detailed description that follows.

DETAILED DESCRIPTION

Figure 1A:
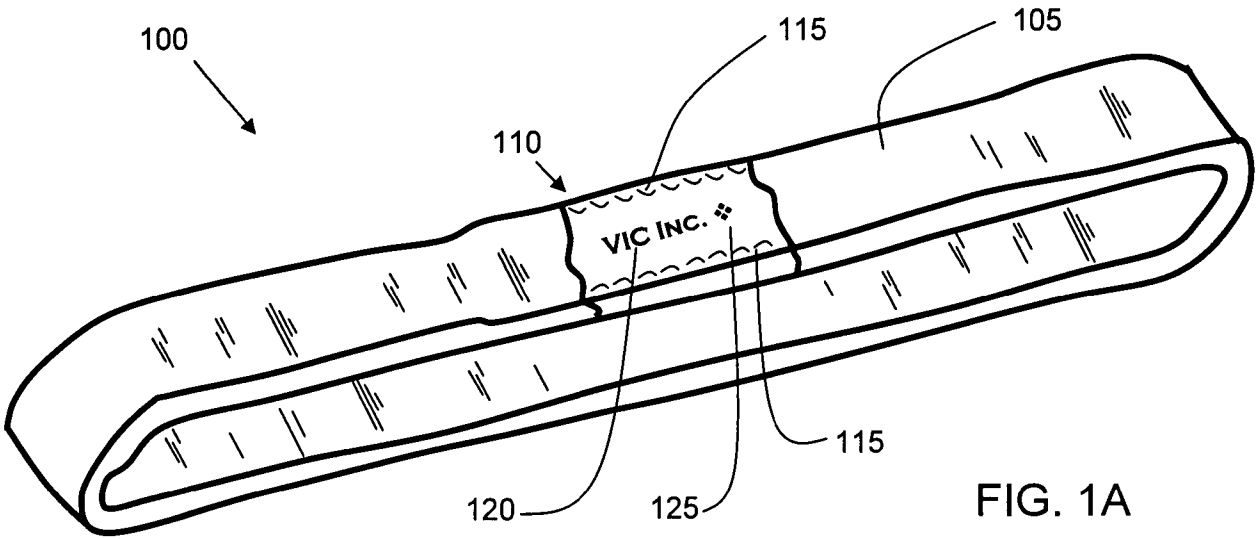
FIG. 1A shows a perspective view of an embodiment of the present invention.
Figure 1B:
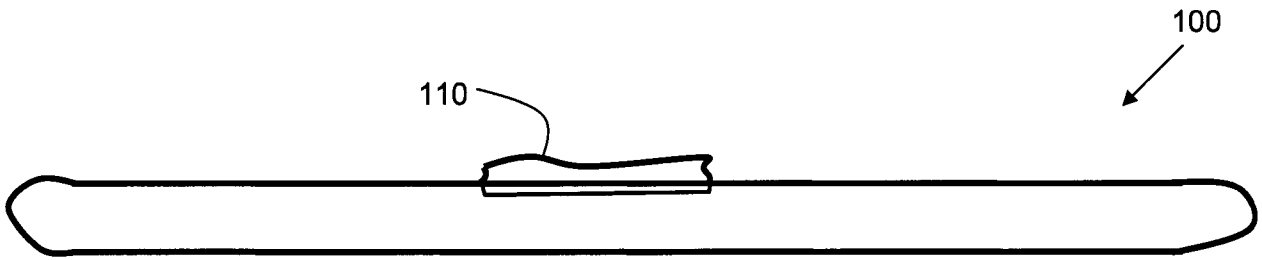
FIG. 1B shows a side view of the embodiment of FIG. 1A.

FIGS. 1A and 1B show views of an embodiment of a towel securing apparatus 100. Towel securing apparatus 100 comprises a strip of material 105 that is formed into a loop, and has a label 110 attached thereto. In one embodiment, the label is fastened to the material 105 via stitching 115. The label 110 may also have text 120 and/or graphics 125 imprinted thereon. The label 110 may be constructed of reflective material, providing for greater visibility in low-light conditions. Note that the particular text 120 and graphics 125 shown are merely presented as an example. It is contemplated that the label may be used for advertising and various other types of promotional purposes (e.g. sports teams, etc.). It is also contemplated that the material 105 may also have text and/or graphics printed directly thereon, and be used for the same purposes as the label 110.

Material 105 is preferably a stretchable, resilient material that is well suited to outdoor use. In one embodiment, the material used is STRETCHRITE elastic material, supplied by Rhode Island Textile Co., of Pawtuckett, R.I. Preferably, material 105 is relatively thin (less than about 0.5 centimeters) to avoid discomfort while in use. In one embodiment, the material 105 that forms the loop is approximately 1-2 inches wide, and a circumference of about 20-30 inches, such that the towel securing apparatus 100 can fit relatively tightly around the back of a chair, thereby securing a towel. The STRETCHITE material has advantages over terrycloth for the purposes of constructing embodiments of the present invention. For example, the STRETCHITE material has a better range of stretch than terrycloth, the stretchability does not degrade, and the material does not hold as much moisture (e.g. rainwater, sweat, etc. . . . ) as does terrycloth. In some embodiments, material 105 may be a "heavy stretch elastic" that is comprised of rubber (ranging from 60 to 70 percent), and polyester (ranging from about 30 percent to about 40 percent). In one embodiment, material 105 is comprised of about 68 percent polyester and about 32 percent rubber.

Figure 2:
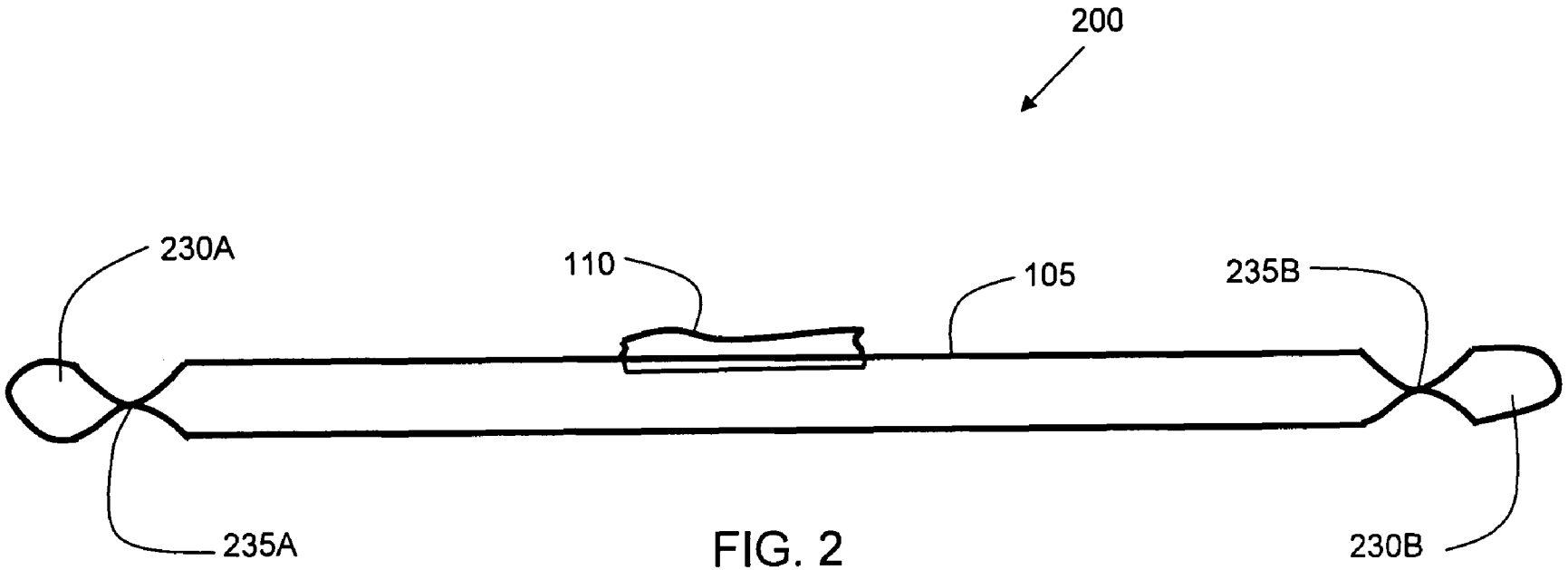
FIG. 2 shows a side view of an alternative embodiment of the present invention.

FIG. 2 shows a side view of an alternative embodiment of a towel securing apparatus 200. Towel securing apparatus 200 further comprises end loops 230A and 230B, disposed at each end of apparatus 200. In one embodiment, end loops 230A and 230B are formed by fastening material 105 together at points 235A and 235B, respectively. End loops 230A and 230B may serve to assist in installing the apparatus 200 over the back of a chair. The end loops 230A and 230B may also serve the function of attaching an item (such as a small pouch for a music player, camera etc. . . . ) to the chair. This serves to keep items off the ground surface, which may be wet or sandy. It may also provide the advantage of keeping items in the pouch from blowing away (e.g. money, tissues, etc. . . . ).

Figure 3:
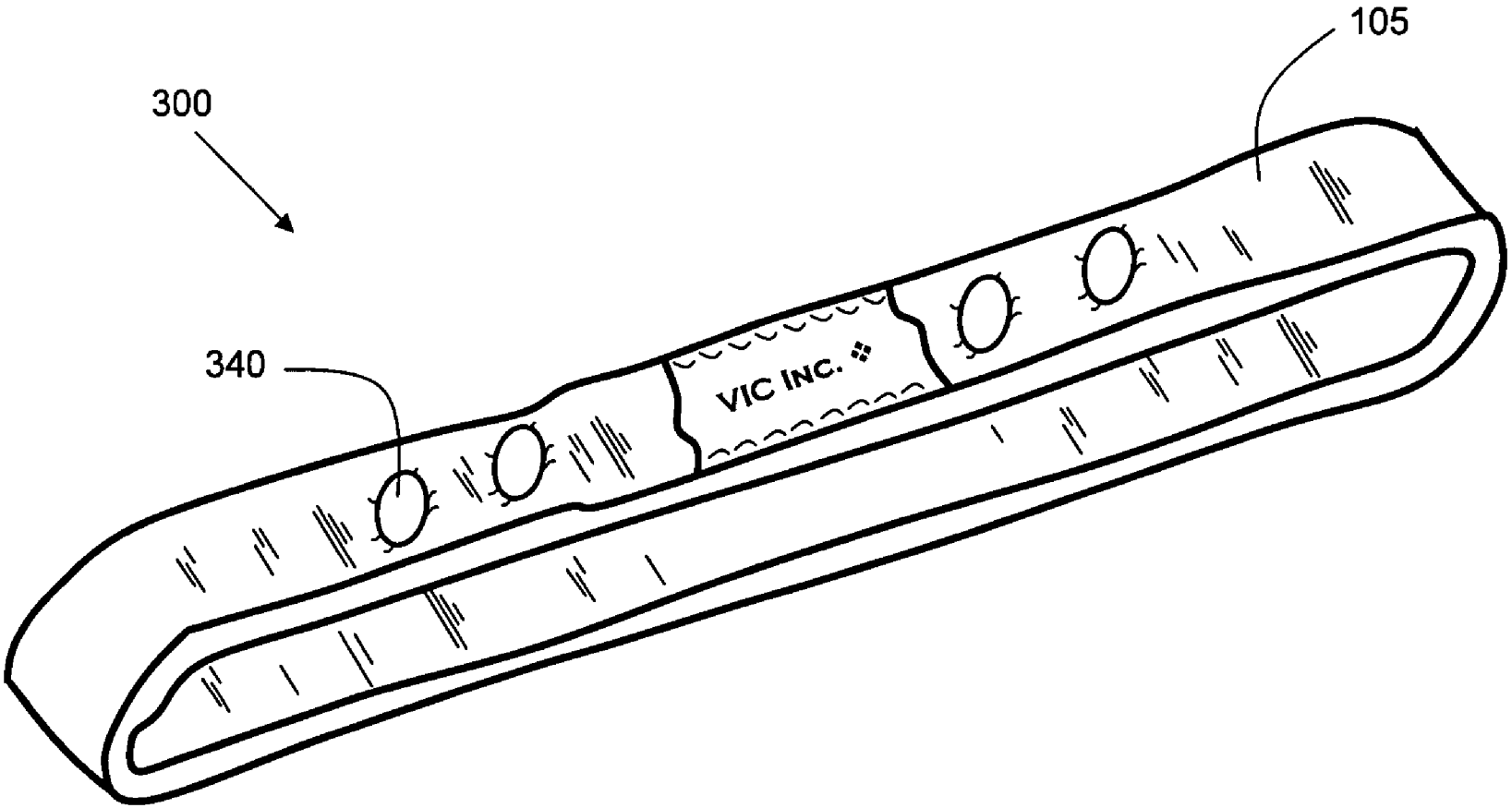
FIG. 3 shows a perspective view of another alternative embodiment of the present invention.

FIG. 3 shows a perspective view of another alternative embodiment of a towel securing apparatus 300. In this embodiment, the material 105 has a plurality of holes 340 formed therein. When apparatus 300 is installed on a chair, preferably, at least some of the plurality of holes 340 are oriented on the back of the chair. In this way, the holes 340 may be used to hang various objects (e.g. keys, mobile phone, etc. . . . ) from the back of the chair, to keep the objects safe from sand and water on a beach. The objects may be suspended from a hole 340 via a hook (not shown), or by looping a strap through the hole 340 (the strap of a camera case, for example).

Figure 4:
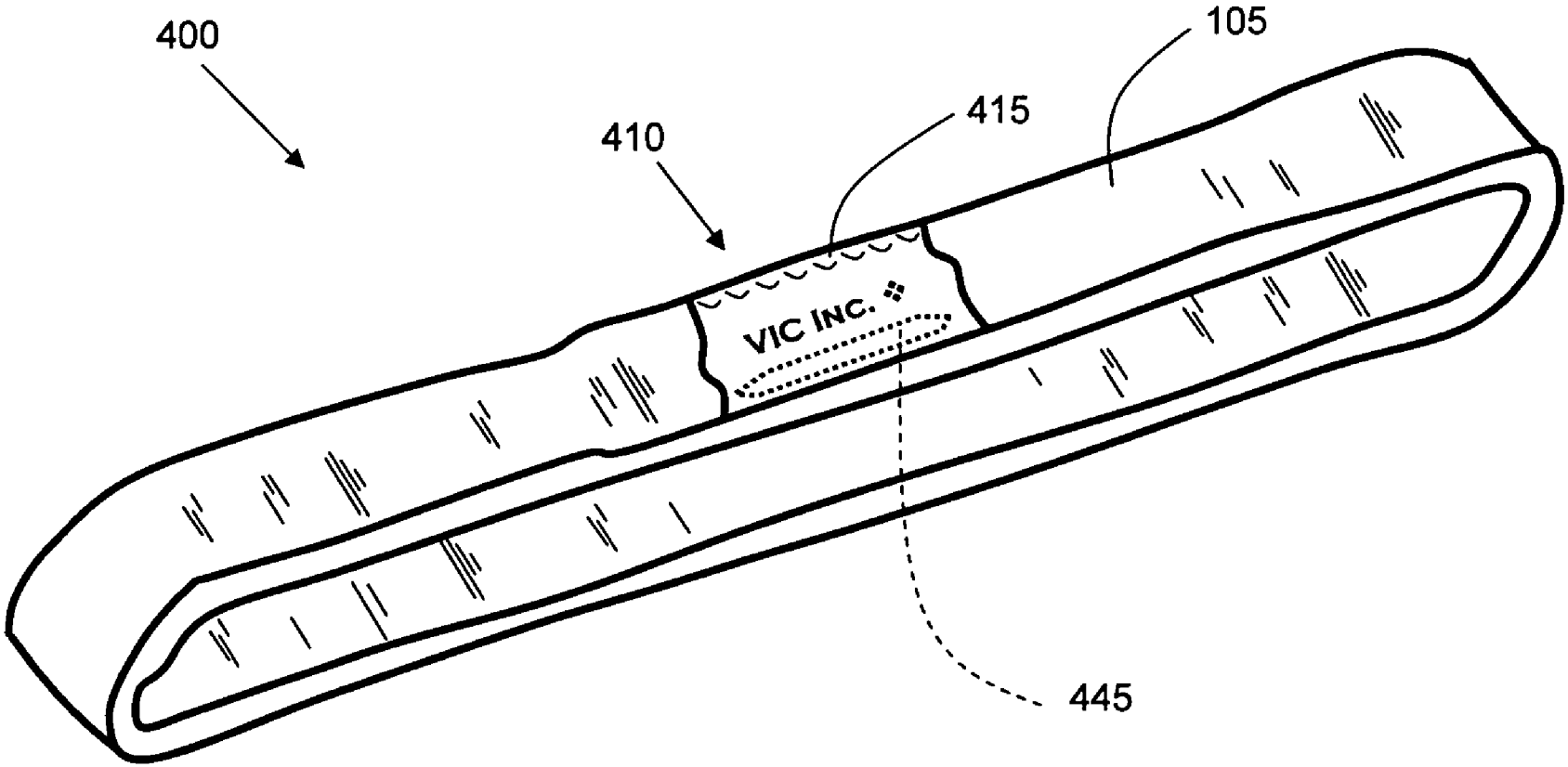
FIG. 4 shows a perspective view of another alternative embodiment of the present invention.

FIG. 4 shows a perspective view of another alternative embodiment of a towel securing apparatus 400. In this embodiment, label 410 is secured with stitching 415 at the upper portion of the label 410. The lower portion of the label optionally has an internal weight 445, which may be comprised of "bean bag" fill (e.g. small particles of polystyrene), a small metal bar, or other material that provides some weight. The weight 445 allows the label 410 to hang from the upper portion of label 410 in a substantially vertical position, even when the chair is in a reclined orientation, thereby facilitating easier viewing from behind. Since advertising is often measured in "impressions," it is desirable to increase the likelihood that the label 410 will be noticed by those sitting or walking behind the chair where apparatus 400 is installed. The weight 445 may provide an additional advantage of giving the user an incentive to install the apparatus 400 such that the label 410 is disposed on the rear of the seat back of a chair. This is because the weight 445 may cause discomfort to the user if the apparatus 400 is installed with the label on the front of the seat back of the chair, where it would contact a user's back when the user is sitting in the chair. Therefore, this may increase the likelihood that the user will install the apparatus 400 with the label 410 in the rear of the seat back of the chair, increasing the effectiveness of the advertising impact of label 410.

Figure 5:
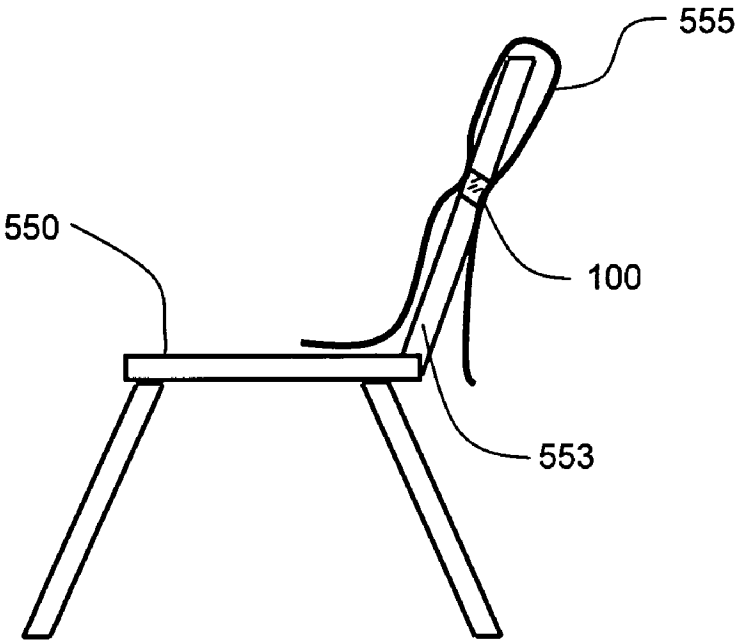
FIG. 5 shows the use of an embodiment of the present invention.

FIG. 5 shows the use of an embodiment of towel securing apparatus 100 as viewed from the side of chair 550. Apparatus 100 is securing towel 555 around the seat back 553 of chair 550, serving to keeping it in place.

Figure 6:
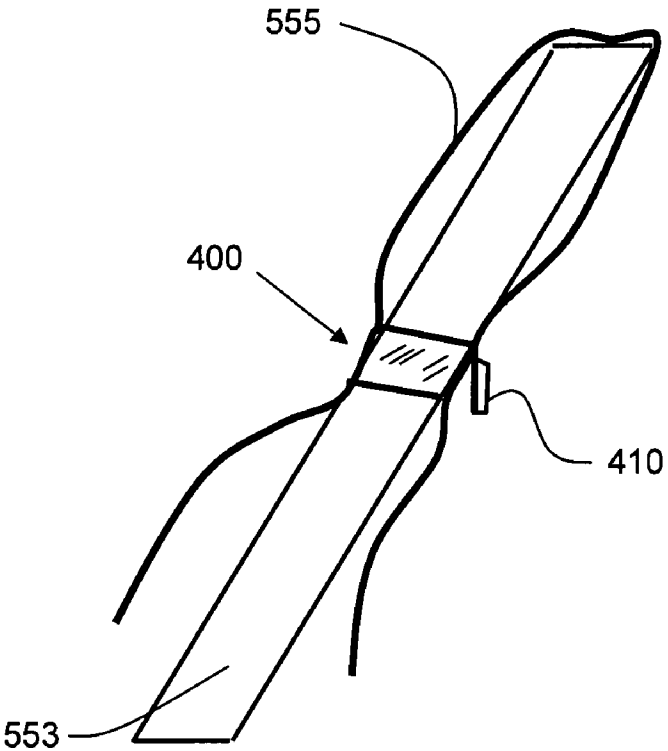
FIG. 6 shows the use of the embodiment of FIG. 4.

FIG. 6 shows a detailed view of the use of an embodiment of towel securing apparatus 400 as viewed from the side of a chair. Note that in this drawing, the entire chair is not shown, but only the seat back 553 is illustrated. Apparatus 400 is securing towel 555 around the seat back 553 of a chair. While the seat back 553 is at an angle with respect to the ground, the label 410 hangs substantially vertical, providing a better viewing angle for people seated, standing, or walking behind the chair on which apparatus 400 is installed.

Figure 7:
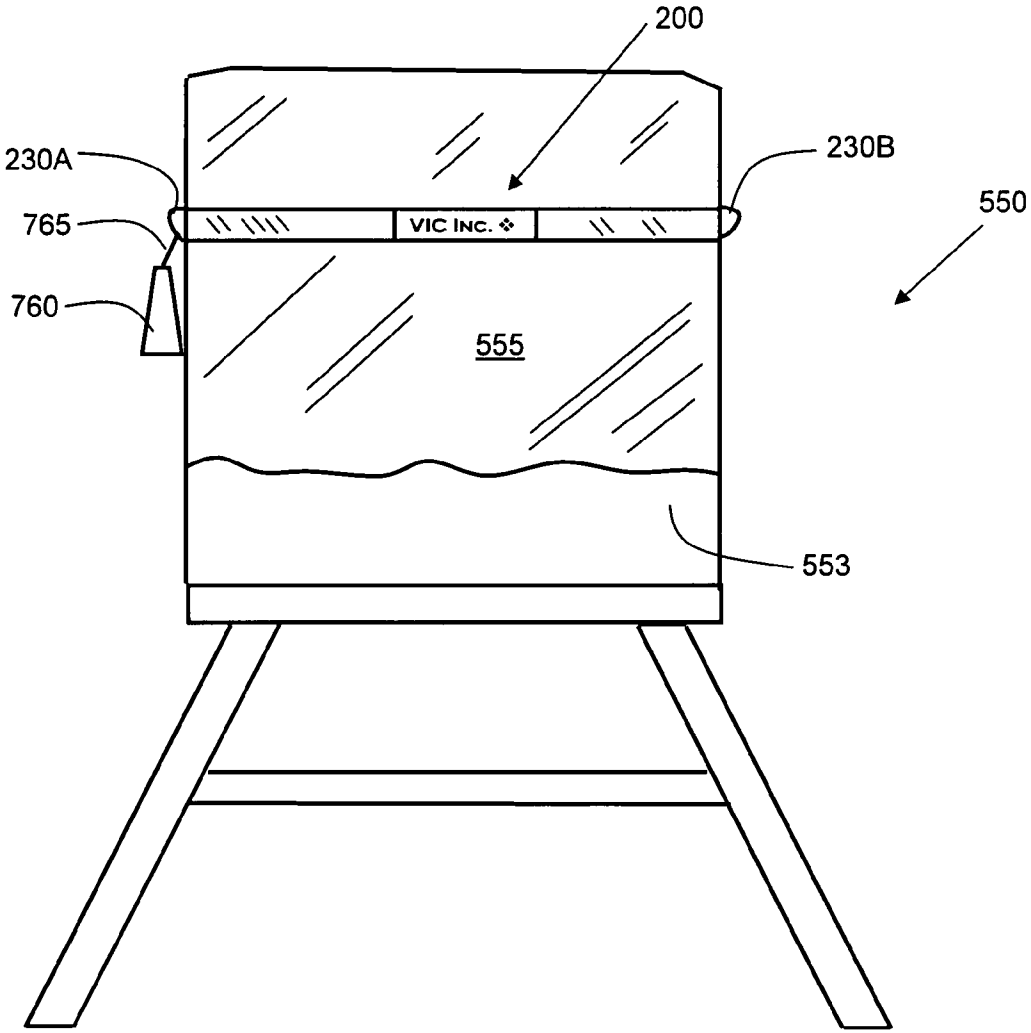
FIG. 7 shows the use of the embodiment of FIG. 2.

FIG. 7 shows the use of an embodiment of towel securing apparatus 200 in a view facing the back of chair 550. Apparatus 200 is securing towel 555 around the seat back 553 of chair 550. The loops 230A and 230B of apparatus 200 are disposed at the respective sides of seat back 553. Loop 230A is attached to pouch 760 by strap 765. It is contemplated that pouch 760 may contain items such as a mobile phone, music player, keys, sunglasses, or other items that a user would typically take to a beach, pool, or on a boat.

Figure 8A:
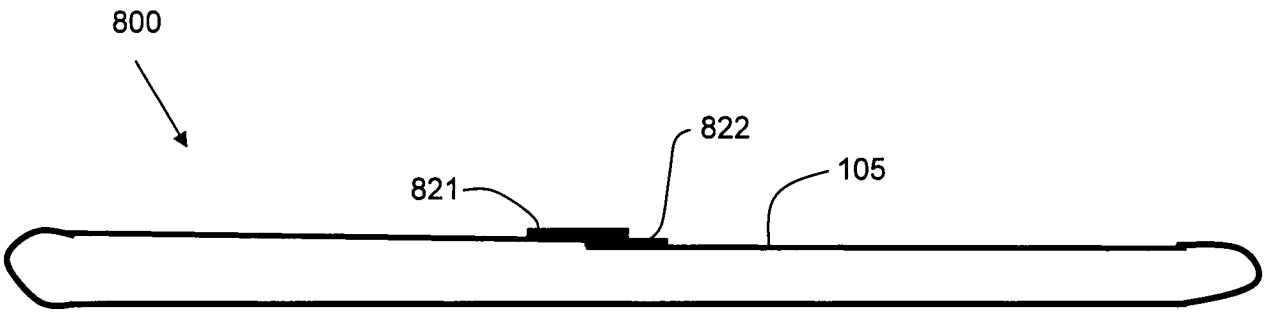
FIGS. 8-9 show alternative embodiments of the present invention.
Figure 8B:
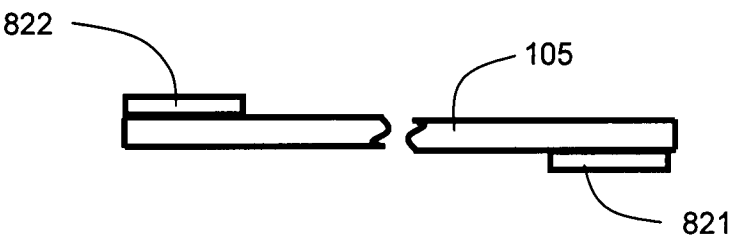

FIGS. 8A and 8B show an alternative embodiment of the present invention. Instead of being stitched into a loop, as with the previous embodiments, this embodiment uses mated fasteners 821, and 822, to attach the two ends of the material 105 in a loop. In one embodiment, fasteners 821 and 822 may be hook-and-loop fasteners, such as VELCRO, for example. In another embodiment, fasteners 821 and 822 may be magnetic fasteners, wherein one fastener is a north biased magnet, and one fastener is a south biased magnet, such that the magnets adhere together when configured as shown in FIG. 8A. It is also contemplated that in this, and possibly other embodiments, information 915 may be printed directly on material 105, thereby eliminating the need for a dedicated label.

Figure 9:
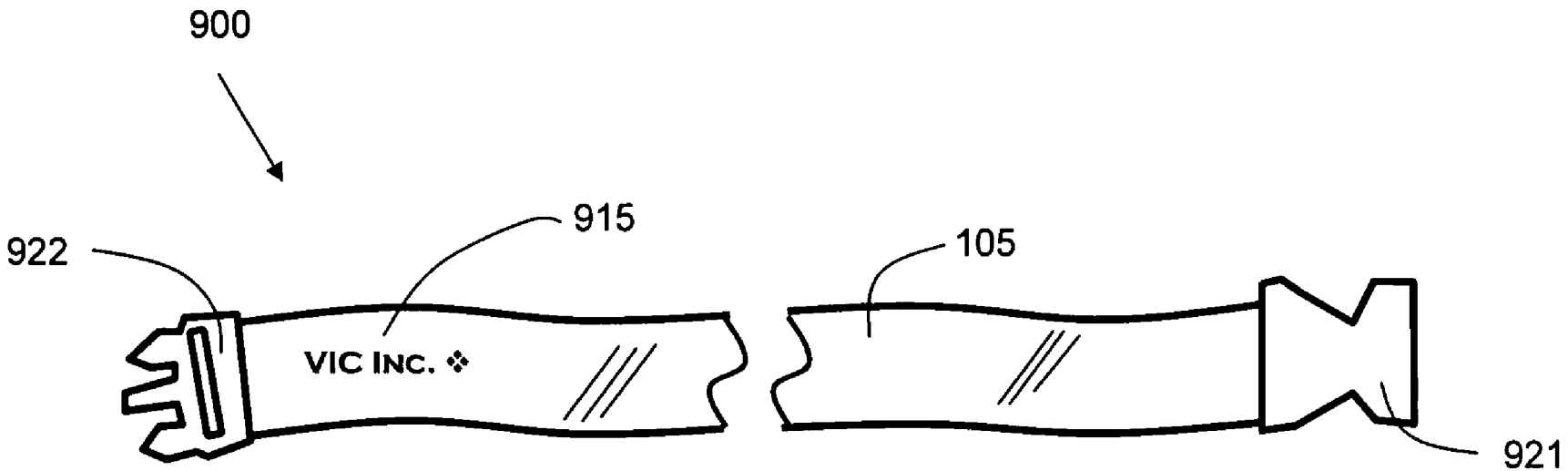

FIG. 9 shows another embodiment of the present invention. In this embodiment, fasteners 921 and 922 are mated clips that snap together to hold material 105 in a loop. Other fastening means are possible, including, but not limited to, snaps, buttons, or clasps, may be used, without departing from the scope of the present invention.

As can be appreciated, embodiments of the present invention provide an effective way to secure a towel onto a chair, thereby enhancing the user experience at a beach, pool, boat, concert, picnic, or other venue, and also improving comfort in automobiles, and other seating surfaces. While various examples discuss outdoor use, embodiments of the present invention are well suited to indoor use too. For example, embodiments of the present invention may be used to secure a towel or cloth or paper sheet to an office chair, barber's chair, or dentist's chair, for example.

Although the invention has been shown and described with respect to a certain preferred embodiment or embodiments, certain equivalent alterations and modifications will occur to others skilled in the art upon the reading and understanding of this specification and the annexed drawings. Numerous variations and modifications will become apparent to those skilled in the art once the above disclosure is fully appreciated. It is intended that the following claims be interpreted to embrace all such variations and modifications.

What is claimed is:

1. An apparatus for securing a towel to a chair, comprising:

a loop of elastic material; a label disposed on the loop, the label comprising an upper portion and a lower portion, wherein the label is attached to the loop of elastic material on the upper portion of the label, and wherein the label is configured to hang from the upper portion, and wherein the lower portion of the label has a weight affixed thereto; two end loops disposed at opposite ends of the loop of elastic material;

a plurality of holes formed within the loop of elastic material; and a pouch, said pouch configured and disposed to hang from one of the two end loops.

2. The apparatus of claim 1, wherein the weight is comprised of bean bag fill material.

3. The apparatus of claim 1, wherein the weight is comprised of metal.

4. The apparatus of claim 1, wherein the loop of elastic material has a width ranging from about 1 inch to about 2 inches, and having a circumference ranging from about 20 inches to about 30 inches.

5. The apparatus of claim 4, wherein the elastic material is comprised of rubber and polyester, wherein the rubber content ranges from about 60 percent to about 70 percent, and the polyester content ranges from about 30 percent to about 40 percent.

6. The apparatus of claim 5, wherein the elastic material is comprised of about 68 percent rubber and about 32 percent polyester, and wherein said elastic material has a width of about two inches.

7. An apparatus for securing a towel to a chair, comprising:

an endlessly closed loop of elastic material;

a label disposed on the loop; and two end loops disposed at predetermined spaced locations on the loop of elastic material to assist in installing the loop over the chair and to serve the function of attaching an item to the chair; and a pouch, said pouch hanging from one of a plurality of holes formed within the loop of elastic material.

8. An apparatus for securing a towel to a chair, comprising:

an endlessly closed loop of elastic material; a label disposed on the loop;

said label comprising an upper portion and a lower portion attached to the loop of elastic material on the upper portion of the label, and configured to hang from the upper portion;

two end loops disposed at opposite ends of the loop of elastic material; and a plurality of holes formed within the loop of elastic material for holding various items such as keys.

9. An apparatus for securing a towel to a chair, comprising: a loop of elastic material; a label disposed on the loop; the label comprising of an upper portion and a lower portion; two end loops disposed at opposite ends of the loop of elastic material; a plurality of holes formed within the loop of elastic material; and a pouch hanging from one of the plurality of holes.

* * * * *